US006790075B1

(12) United States Patent
Sung

(10) Patent No.: US 6,790,075 B1
(45) Date of Patent: Sep. 14, 2004

(54) SERIAL ATA INTERFACE CONNECTOR

(76) Inventor: Yun-Ching Sung, No. 53-2, Community 6, Chih Pa Sub-ward, ChungLi, TaoYuan Hsien (TW)

( * ) Notice: Subject to any disclaimer, the term of this patent is extended or adjusted under 35 U.S.C. 154(b) by 0 days.

(21) Appl. No.: 10/621,419

(22) Filed: Jul. 18, 2003

(51) Int. Cl.[7] ..... H01R 9/07
(52) U.S. Cl. ..... 439/499; 439/397; 439/405
(58) Field of Search ..... 439/397, 399, 439/405, 443, 499, 877

(56) References Cited

U.S. PATENT DOCUMENTS 5,226,835 A * 7/1993 Baker et al. ..... 439/403
5,643,005 A * 7/1997 Weidler et al. ..... 439/405
5,820,404 A * 10/1998 Chishima et al. ..... 439/417
5,911,594 A * 6/1999 Baker et al. ..... 439/404

* cited by examiner

*Primary Examiner*—Thanh-Tam Le
(74) *Attorney, Agent, or Firm*—Rosenberg, Klein & Lee

(57) ABSTRACT

A Serial ATA interface connector includes a connector body holding a set of terminals of two different lengths alternatively arranged in parallel, each terminal having a vertically extended conductor holder at the rear end outside the conductor holder, the conductor holder having a Y-shaped retaining notch, a Serial ATA interface cable having conductors respectively fastened to the Y-shaped retaining notches of the conductors, a bottom cover shell and a top cover shell fastened together by a hook joint to hold down the connector body and the outer insulative layer of the Serial ATA interface cable, the top and bottom covers having positioning holes for the positioning of the conductor holders of the terminals.

7 Claims, 9 Drawing Sheets

SERIAL ATA INTERFACE CONNECTOR

BACKGROUND OF THE INVENTION

1. Field of the Invention

The present invention relates to a SATA (Serial AT Attachment) interface connector and, more particularly, to such a SATA interface connector, which keeps the conductors of the SATA interface cable positively connected to the conductors in the connector body without solder.

2. Description of the Related Art

FIG. 1 illustrates a conventional bus line connector for use in computer. This design of bus line connector requires much installation space because the bus line 11 is comprised of more than seventy signal lines arranged in parallel. Therefore, various Serial ATA interface connectors are developed. Serial ATA is the next generation storage interface standard for personal computer designed to replace the Ultra ATA parallel interconnect cable (80 conductors) with a much smaller, more flexible serial design. FIGS. 2A and 2B show a Serial ATA interface connector according the prior art. According to this design, the Serial ATA interface connector comprises a connector body 13, a plurality of terminals 14 mounted in the connector body 13, a Serial ATA interface cable 15 having conductors 151 respectively soldered to the terminals 14, and an electrically insulative outer shell 16 molded on a part of the connector body 13 and a part of the Serial ATA interface cable 15. This design of Serial ATA interface connector has drawbacks as follows:

1. It consumes much time to solder the conductors 151 to the terminals 14 by labor. When soldering the conductors 151 to the terminals 14, toxic waste gas is produced.

2. The conductors 151 are thin wire conductors and the two conductors on the middle are commonly soldered to a common terminal, improper soldering affects the electric properties of the connector.

3. When molding the electrically insulative outer shell 16, the molding pressure may distort the conductors 151, resulting in a short circuit.

Therefore, it is desirable to provide a Serial ATA interface connector that eliminates the aforesaid drawbacks.

SUMMARY OF THE INVENTION

The present invention has been accomplished under the circumstances in view. It is therefore the main object of the present invention to provide a Serial ATA interface connector, which eliminates the procedure of soldering to connect the conductors to the terminals. It is another object of the present invention to provide a Serial ATA interface connector, which keeps the terminals and the conductors in position, preventing interference. To achieve these and other objects and according to one aspect of the present invention, the Serial ATA interface connector comprises a connector body holding a set of terminals, each terminal having a vertically extended conductor holder at the rear end outside the conductor holder, the conductor holder having a Y-shaped retaining notch, a Serial ATA interface cable having conductors respectively fastened to the Y-shaped retaining notches of the conductors, a bottom cover shell and a top cover shell fastened together to hold down the connector body and the outer insulative layer of the Serial ATA interface cable, the top and bottom covers having positioning holes for the positioning of the conductor holders of the terminals. According to another aspect of the present invention, the terminals have two different lengths alternatively arranged in parallel. According to another aspect of the present invention, the top cover shell has hook holes and bottom pins respectively fastened to respective upright hooks and pin holes in the bottom cover shell to hold down the connector body and the Serial ATA interface cable.

DETAILED DESCRIPTION OF THE PREFERRED EMBODIMENT

Figure 1:
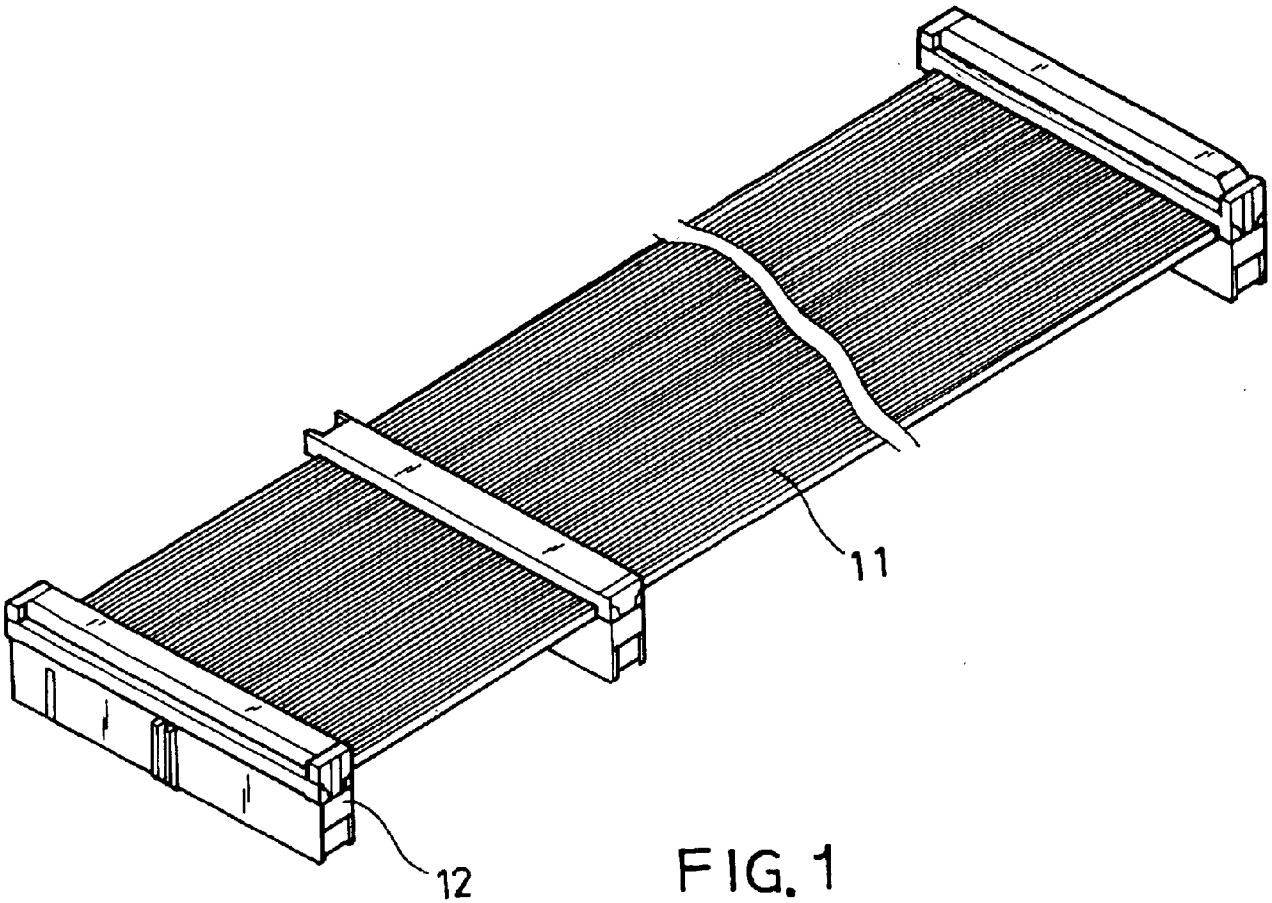
FIG. 1 (PRIOR ART)
FIG. 1 is a bus line connector according to the prior art.
Figure 2A:
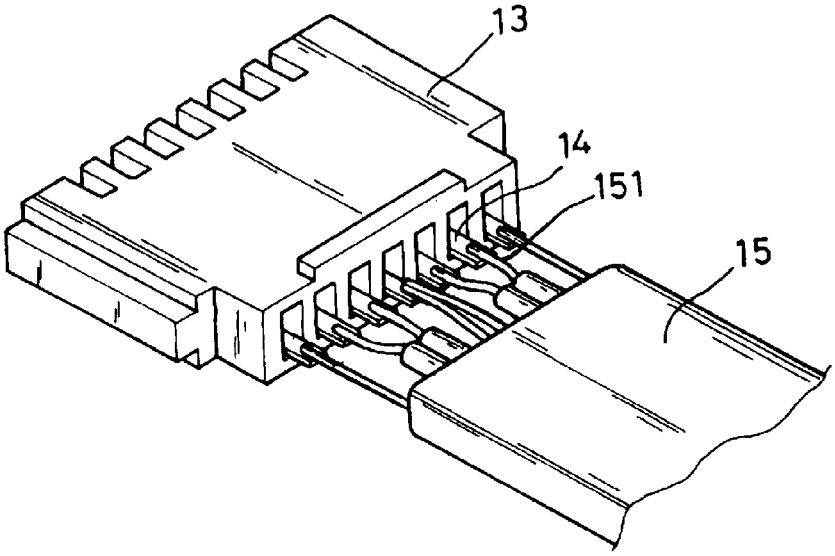
FIG. 2(A) (PRIOR ART)
FIG. 2A illustrates a Serial ATA interface cable connected to a connector body for Serial ATA interface connector according to the prior art.
Figure 2B:
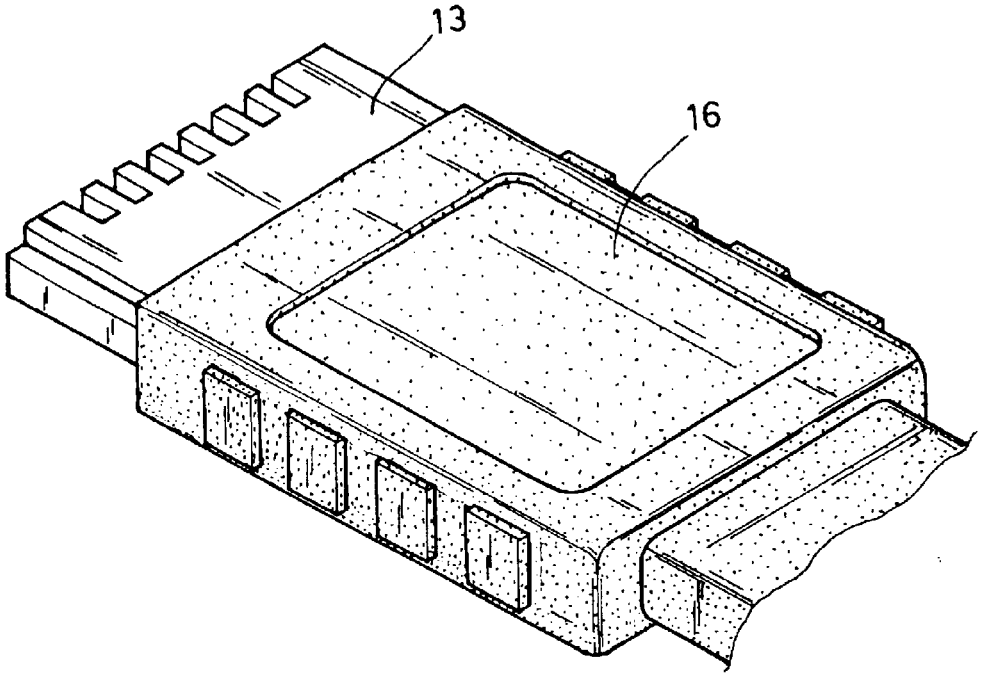
FIG. 2(B) (PRIOR ART)
FIG. 2B is an elevational view of a Serial ATA interface connector according to the prior art.
Figure 3:
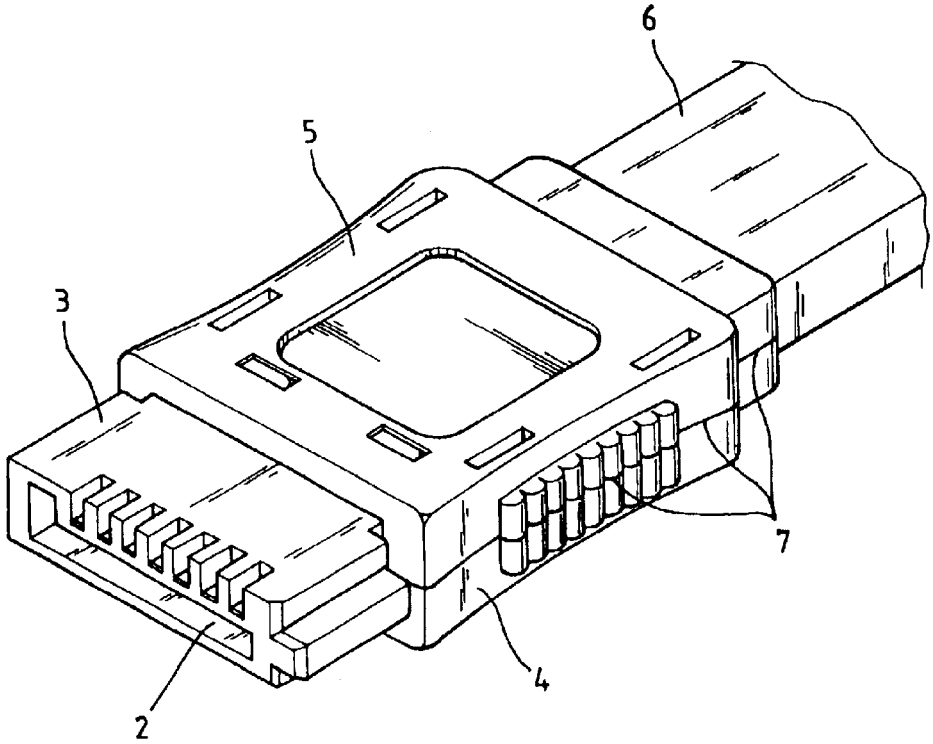
FIG. 3 is an elevational view of a Serial ATA interface connector according to the present invention.
Figure 4:
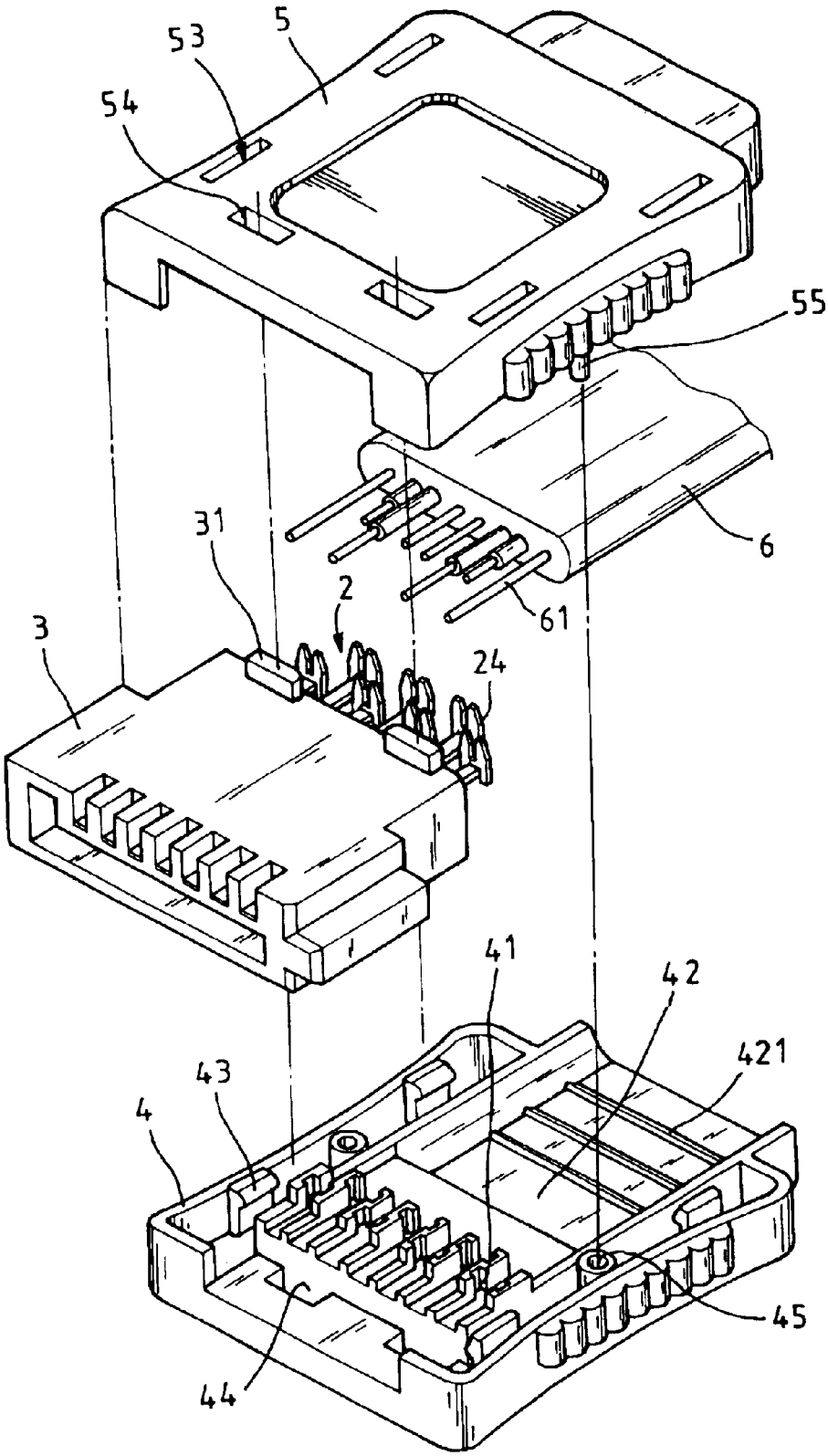
FIG. 4 is an exploded view of the Serial ATA interface connector according to the present invention.
Figure 5:
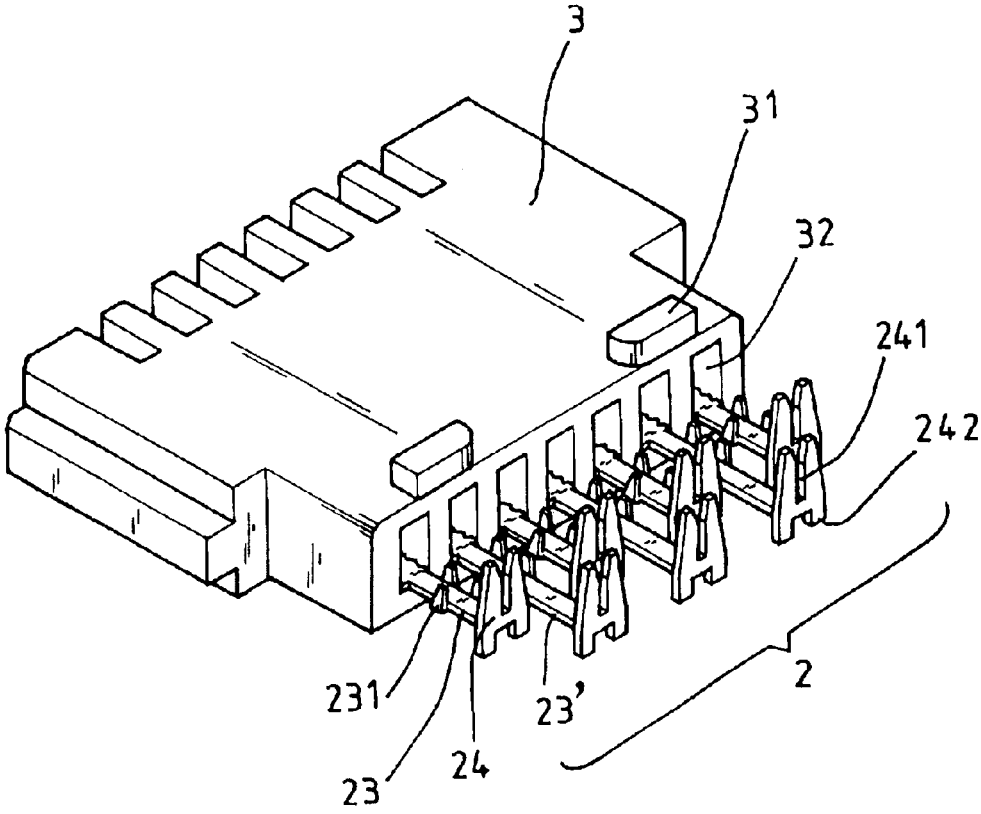
FIG. 5 is an oblique rear elevation of a part of the present invention, showing the terminals installed in the connector body.

Referring to FIGS. 3~5, a Serial ATA interface connector is shown comprised of a set of terminals 2, a connector body 3, a bottom cover shell 4, and a top cover shell 5. The terminals 2 are respectively mounted in the connector body 3. The bottom cover shell 4 has a plurality of positioning holes 41 in the top side corresponding to the terminals 2, a cable chamber 42 in the top side behind the positioning holes 41, a plurality of upright hooks 43 symmetrically disposed at two sides, a plurality of upwardly extended locating holes 44, and a plurality of upwardly extended pin holes 45.

Figure 6:
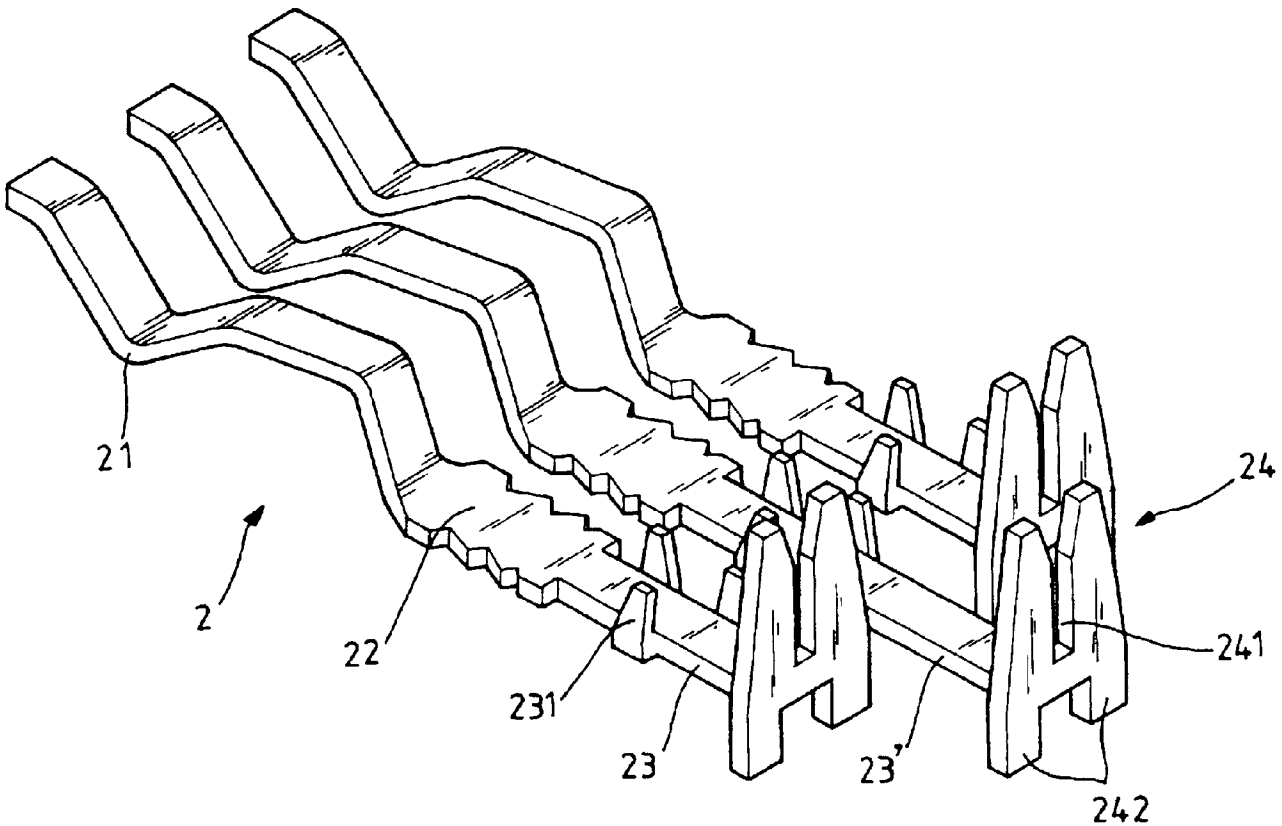
FIG. 6 is elevational view of terminals for the Serial ATA interface connector according to the present invention.

Referring to FIG. 6, each terminal 2 comprises a front spring arm 21, an elongated endpiece 23 or 23', and a middle positioning portion 22 connected between the front spring arm 21 and the elongated endpiece 23 or 23'. The elongated endpiece 23 or 23' is terminating in a vertically extended conductor holder 24, which defines an upwardly extended and substantially Y-shaped retaining notch 241. The terminals 2 include first terminals having a relatively shorter endpiece 23 and second terminals having a relatively longer endpiece 23'. The first and second terminals 2 are alternatively arranged in parallel. The conductors 61 of a Serial ATA interface cable 6 are respectively engaged into the Y-shaped retaining notches 241 of the terminals 2 (the two middle grounding conductors of the SATA interface cable 6 are fastened to the Y-shaped retaining notch 241 of one common terminal.

Referring to FIGS. 3 and 4 again, the top cover shell 5 is covered on the bottom cover shell 4, having a plurality of positioning holes 51 for the positioning of the conductor holders 24 of the terminals 2, a plurality of hook holes 53 respectively forced into engagement with the upright hooks 43 of the bottom cover shell 4, a plurality of bottom pins 55 respectively plugged into the pin holes 45 of the bottom cover shell 4, and a plurality of locating holes 54 corresponding to the locating holes 44 of the bottom cover shell 4. The connector body 3 is sandwiched in between the bottom cover shell 4 and the top cover shell 5, having a plurality of top and bottom locating blocks 31 respectively engaged into the locating holes 44 of the bottom cover shell 4 and the locating holes 54 of the top cover shell 5. When the connector body 3 and the cover shells 4 and 5 assembled, the connection area 7 between the bottom cover shell 4 and the top cover shell 5 is sealed by a high-frequency heat sealing apparatus.

Figure 7:
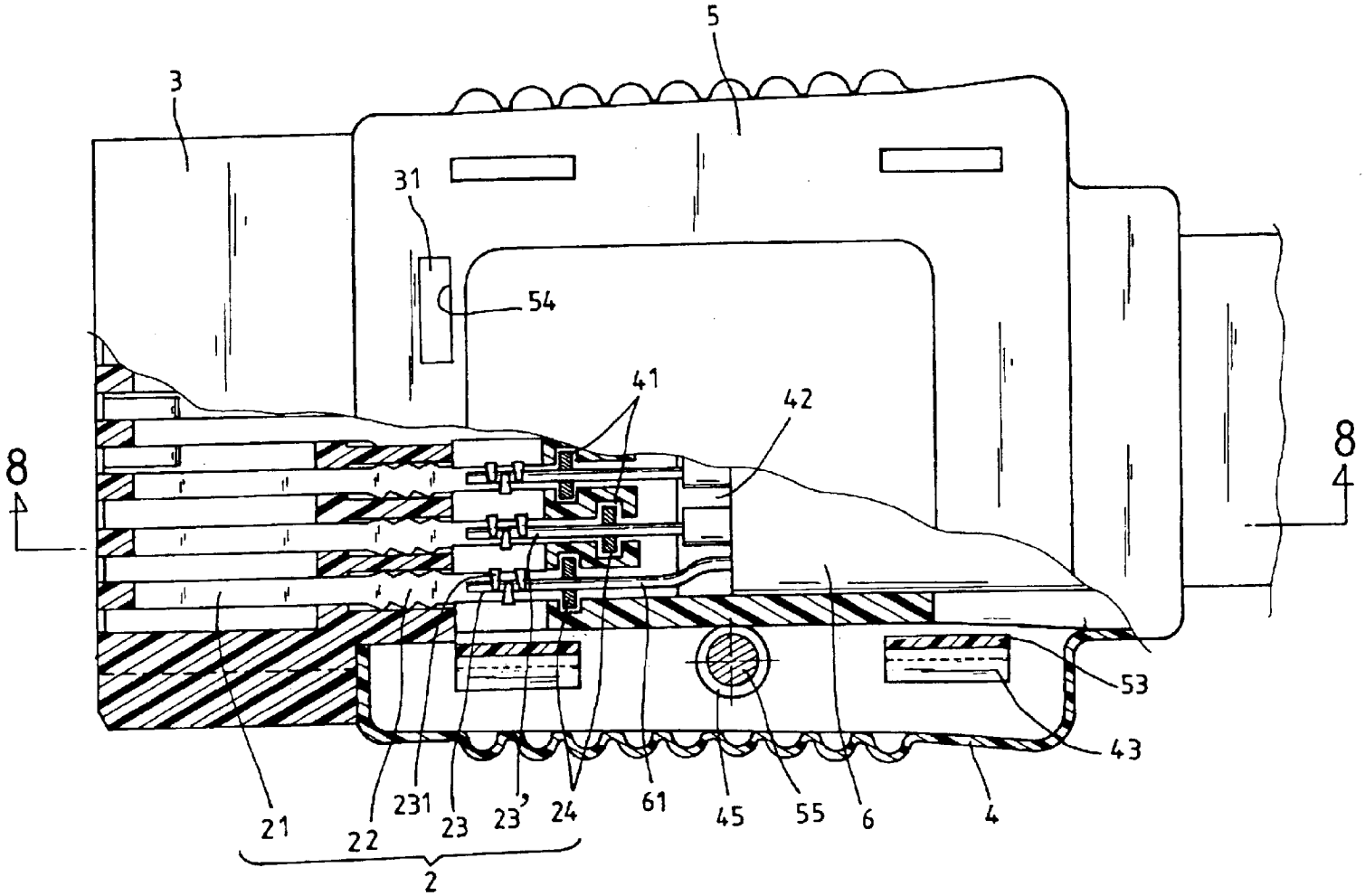
FIG. 7 is a top view, partially in section, of the Serial ATA interface connector according to the present invention.

Referring to FIG. 7, the front spring arms 21 of the terminals 2 are respectively inserted into the connector body 3, keeping the respective middle positioning portions 22 positioned in the respective terminal slots 22 inside the connector body 3 and the respective endpieces 23 and 23' suspended outside the connector body 3 and positioned in the positioning holes 41 of the bottom cover shell 4 with the respective conductor holders 24 respectively engaged into the positioning holes 51 of the top cover shell 5; the conductors 61 of the Serial ATA interface cable 6 are fastened to the Y-shaped retaining notches 241 of the conductor holders 24 of the terminals 2.

Figure 8:
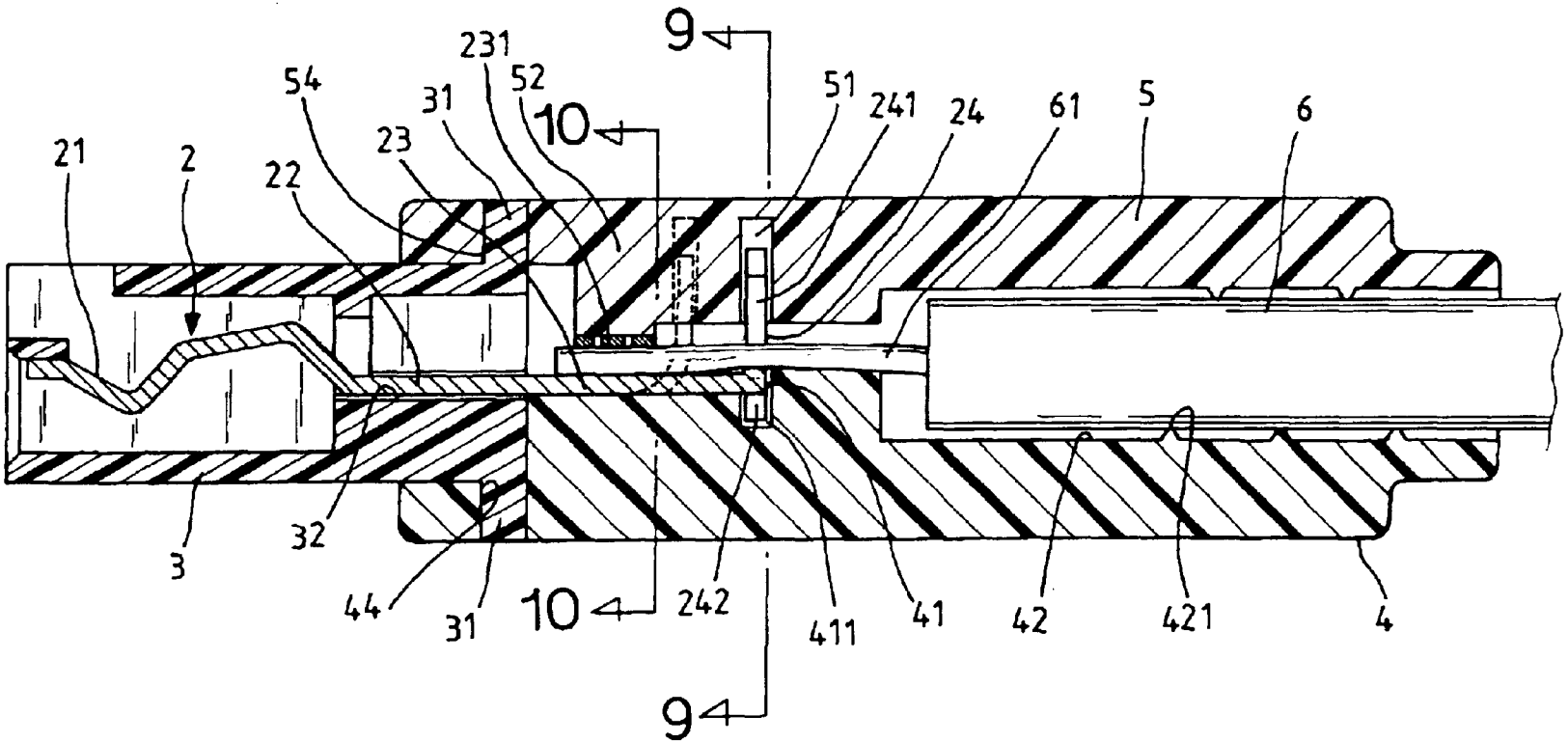
FIG. 8 is a sectional view taken along line 8—8 of FIG. 7.
Figure 9:
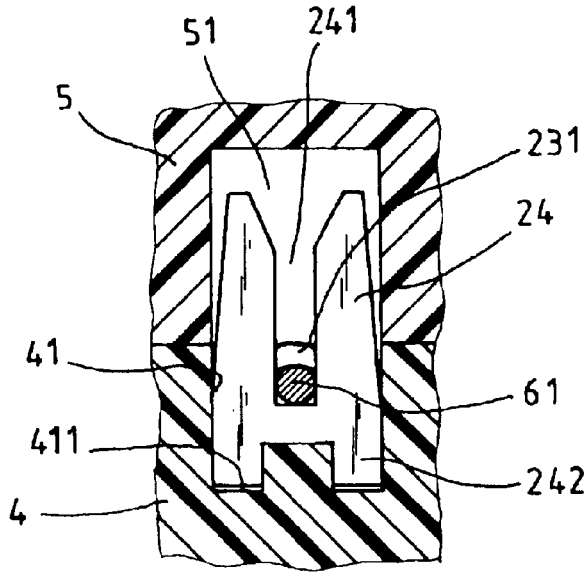
FIG. 9 is a sectional view taken along line 9—9 of FIG. 8.

Referring to FIG. 8 and FIG. 7 again, the conductors 61 of the Serial ATA interface cable 6 are fastened to the terminals 2 without solder. After installation of the terminals 2 in the connector body 3, the conductor holders 24 are alternatively aligned in two rows, preventing interference or accidental contact between each two adjacent conductors 61. Therefore, the invention greatly improves the yielding of the fabrication of Serial ATA interface connectors.

Referring to FIGS. 4 and 8 again, the bottom cover shell 4 further comprises a plurality of ribs 421 transversely located on the cable chamber 42. The structure of the rear half of the top cover shell 5 is similar to the rear half of the bottom cover shell 4, i.e., the top cover shell 5 has a cable chamber and ribs in the cable chamber. When assembled, the ribs 421 of the cover shells 4 and 5 are pressed on the Serial ATA interface cable 6 from the top and bottom sides, and therefore the Serial ATA interface cable 6 is firmly secured to the Serial ATA interface connector.

Referring to FIGS. 9 and 10, and FIGS. 5~8 again, each terminal 2 further comprises a plurality of clamping strips 231 at two opposite lateral sides of the endpiece 23 or 23'. The width of the bottom end of the Y-shaped retaining notch 241 is smaller than the diameter of the conductors 61 of the Serial ATA interface cable 6. After insertion of the corresponding conductor 61 in the Y-shaped retaining notch 241, the spring power of the conductor holder 24 imparts a clamping force to the conductor 61, keeping the conductor 61 positively positioned in the Y-shaped retaining notch 241. After positioning of the corresponding conductor 61 in the Y-shaped retaining notch 241 of the conductor holder 24, the clamping strips 231 are crimped by a tool, for example, a crimper, to hold down the conductor 61 firmly in position. Further, because the outer insulative layer of the Serial ATA interface cable 6 is firmly secured in between the ribs 421 of the cover shells 4 and 5, the connection between the Serial ATA interface cable 6 and the Serial ATA interface connector is re-ensured. This design keeps the conductors 61 connected to the terminals 2 straightly in line, preventing signal distortion.

Referring to FIGS. 8 and 9 again, the terminal holder 24 of each terminal 2 has two bottom legs 242 respectively plugged into respective locating grooves 411 in the locating holes 41 of the bottom cover shell 4. Because the top and bottom sides of the conductor holders 24 of the terminals 2 are respectively positioned in the positioning holes 51 of the top cover shell 5 and the positioning holes 41 of the bottom shell 4, the conductor holders 24 are positively secured in position.

Figure 10:
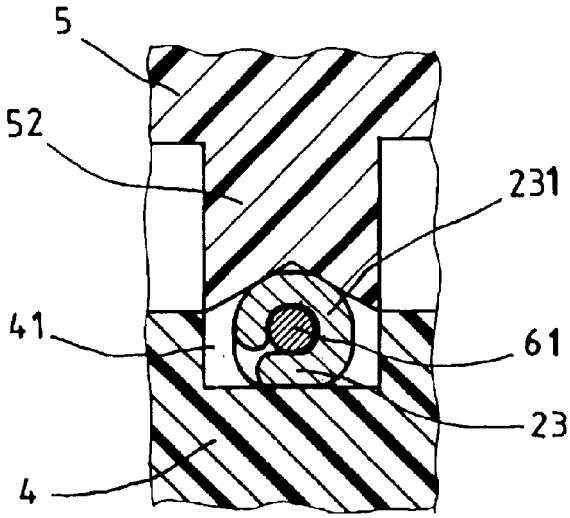
FIG. 10 is a sectional view taken along line 10—10 of FIG. 8.

A prototype of Serial ATA interface connector has been constructed with the features of the annexed drawings of FIGS. 31~10. The SATA interface connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A Serial ATA interface connector comprising:

a connector body;

a plurality of terminals mounted in said connector body, said terminals including short terminals and long terminals alternatively arranged in parallel, said terminals each having an endpiece extended out of a rear side of said connector body and terminating in a respective vertically extended conductor holder, said conductor holder having an upwardly extended Y-shaped retaining notch;

a bottom cover shell adapted to accommodate said connector body, said bottom cover shell comprising a rear cable chamber, a plurality of positioning holes adapted to accommodate the conductor holders of said terminals, and a plurality of upright hooks symmetrically disposed at two opposite lateral sides;

a Serial ATA interface cable inserted into the rear cable chamber of said bottom cover shell, said Serial ATA interface comprising a plurality of conductors respectively engaged into the Y-shaped retaining notches of the conductor holders of said terminals; and a top cover shell covered on said bottom cover shell to hold down said connector body and said Serial ATA interface cable, said top cover shell comprising a cable chamber adapted to accommodate said Serial ATA interface cable, and a plurality of hook holes respectively fastened to the upright hooks of said bottom cover shell.

2. The Serial ATA interface connector as claimed in claim 1, wherein said terminals each further comprise a plurality of clamping strips bilaterally disposed in front of the respective conductor holders and adapted to clamp the conductors of said Serial ATA interface cable.

3. The Serial ATA interface connector as claimed in claim 1, wherein the conductor holder of each of said terminals comprises two bottom legs respectively positioned in respective locating grooves in the positioning holes of said bottom cover shell.

4. The Serial ATA interface connector as claimed in claim 1, wherein said top cover shell further comprises a plurality of positioning holes adapted to accommodate the conductor holders of said terminals.

5. The Serial ATA interface connector as claimed in claim 1, wherein said top cover shell and said bottom cover shell each comprise a plurality of transverse ribs respectively disposed in the respective rear cable chamber and adapted to hold down said Serial ATA interface cable.

6. The Serial ATA interface connector as claimed in claim 1, wherein said bottom cover shell further comprises a plurality of upwardly extended pin holes; said top cover shell further comprises a plurality of bottom pins respectively plugged into the pin holes of said bottom cover shell.

7. The Serial ATA interface connector as claimed in claim 1, wherein said top cover shell and said bottom cover shell are peripherally sealed by a high-frequency heat sealing apparatus.

* * * * *